US009427740B2

(12) United States Patent
Matthews

(10) Patent No.: US 9,427,740 B2
(45) Date of Patent: Aug. 30, 2016

(54) VERTICAL TOP-FED GRAIN MILL

(71) Applicant: Satake USA, Inc., Stafford, TX (US)

(72) Inventor: Peter Mathieson Matthews, Katy, TX (US)

(73) Assignee: Satake USA, Inc., Stafford, TX (US)

( * ) Notice: Subject to any disclaimer, the term of this patent is extended or adjusted under 35 U.S.C. 154(b) by 154 days.

(21) Appl. No.: 14/159,701

(22) Filed: Jan. 21, 2014

(65) Prior Publication Data

US 2015/0202628 A1 Jul. 23, 2015

(51) Int. Cl.
*B02C 9/00* (2006.01)
*B02B 3/04* (2006.01)

(52) U.S. Cl.
CPC .... *B02B 3/04* (2013.01); *B02C 9/00* (2013.01)

(58) Field of Classification Search
CPC ..... B02C 2/10; B02C 4/02; B02C 7/08; B02C 9/00; B02C 9/02; B02C 3/04
USPC ..... 241/74, 249, 257.1, 260
See application file for complete search history.

(56) References Cited

U.S. PATENT DOCUMENTS

| | | | | |
|---|---|---|---|---|
| 2,010,989 | A * | 8/1935 | Hatton | 241/43 |
| 3,477,855 | A | 11/1969 | Freeman | |
| 3,897,017 | A | 7/1975 | Rogers et al. | |
| 4,057,194 | A | 11/1977 | Orton | |
| 4,109,873 | A | 8/1978 | Lichfield | |
| 4,290,560 | A | 9/1981 | Tabah | |
| 4,323,006 | A | 4/1982 | Satake | |
| 4,426,921 | A | 1/1984 | Meinardus | |
| 4,426,922 | A | 1/1984 | Yamamoto | |
| 4,663,030 | A * | 5/1987 | Chupka et al. | 209/306 |
| 4,843,957 | A | 7/1989 | Satake | |
| 4,896,592 | A | 1/1990 | Satake | |
| 5,025,993 | A | 6/1991 | Satake | |
| 5,211,343 | A | 5/1993 | Wellman | |
| 5,271,570 | A | 12/1993 | Satake et al. | |
| 5,390,589 | A | 2/1995 | Satake et al. | |
| 5,394,792 | A | 3/1995 | Satake | |

(Continued)

FOREIGN PATENT DOCUMENTS

| | | |
|---|---|---|
| CN | 2243333 | 12/1996 |
| JP | 0478452 A | 3/1992 |

(Continued)

OTHER PUBLICATIONS

Shane Thomas, International Search Report—PCT/US15/11509, Apr. 13, 2015, 2 pages, U.S. Patent and Trademark Office as International Searching Authority, Alexandria, Virginia USA.

(Continued)

*Primary Examiner* — Mark Rosenbaum
(74) *Attorney, Agent, or Firm* — Crain, Caton & James, P.C.; James E. Hudson, III

(57) ABSTRACT

A top-fed vertical grain mill which causes intermittent compression of grains while reducing potential overmilling. The top-fed vertical grain mill includes a resistor bar, a plurality of rolls having a smooth, metal vertical outer periphery on which a vertically-aligned stirring bar is positioned, and a bran removal cylinder having a plurality of perforations therethrough, which may be throughout or which may be below the bottom surface of the top-most of the plurality of rolls.

18 Claims, 6 Drawing Sheets

(56) References Cited

U.S. PATENT DOCUMENTS

| | | | | |
|---|---|---|---|---|
| 5,511,731 | A | 4/1996 | Schmidt | |
| 5,752,664 | A * | 5/1998 | Satake et al. | 241/74 |
| 5,773,066 | A | 6/1998 | Satake et al. | |
| 5,846,591 | A | 12/1998 | Satake et al. | |
| 6,199,777 | B1 | 3/2001 | Satake et al. | |
| 6,936,294 | B2 | 8/2005 | Matthews | |
| 7,553,507 | B2 | 6/2009 | Matthews | |
| 2005/0220952 | A1 | 10/2005 | Matthews | |
| 2005/0226978 | A1 | 10/2005 | Matthews | |
| 2005/0226979 | A1 | 10/2005 | Matthews | |
| 2008/0226784 | A1 | 9/2008 | Matthews | |
| 2011/0284670 | A1 | 11/2011 | Jenkins et al. | |
| 2012/0067990 | A1 | 3/2012 | Seto | |
| 2013/0119170 | A1 | 5/2013 | Pape | |

FOREIGN PATENT DOCUMENTS

| | | | |
|---|---|---|---|
| JP | 04197455 | A | 7/1992 |
| JP | 0881063 | A | 3/1996 |
| JP | 10180126 | A | 7/1998 |

OTHER PUBLICATIONS

Shane Thomas, Written Opinion of the International Searching Authority—PCT/US15/11509, Apr. 13, 2015, 8 pages, U.S. Patent and Trademark Office as International Search Authority, Alexandria, Virginia USA.

Mark Rosenbaum, Written Opinion of the International Preliminary Examining Authority—PCT/US15/11509, Mar. 16, 2016, 3 pages, USPTO as Examining Authority, Alexandria, Virginia, USA.

Mark Rosenbaum, International Preliminary Report on Patentability-PCT/US15/11509, Jun. 22, 2016, 3 pages, USPTO as Examining Authority, Alexandria, Virginia, USA.

* cited by examiner

| | 3.5 | 4 | 5 | 6 | 18 | 40 | 50 | -50 |
|---|---|---|---|---|---|---|---|---|
| VTA Std Corn | 7.49% | 10.63% | 25.28% | 13.49% | 15.35% | 0.20% | 0.00% | 0.00% |
| VTA #1 Corn | 5.72% | 15.89% | 23.13% | 17.44% | 15.92% | 0.17% | 0.00% | 0.00% |
| VBF Std Corn | 28.70% | 11.28% | 17.72% | 8.42% | 10.78% | 0.45% | 0.00% | 0.00% |
| VBF #1 Corn | 29.89% | 16.58% | 16.83% | 9.16% | 9.06% | 0.32% | 0.00% | 0.00% |

VERTICAL TOP-FED GRAIN MILL

CROSS-REFERENCE TO RELATED APPLICATIONS

None.

STATEMENT REGARDING FEDERALLY SPONSORED RESEARCH OR DEVELOPMENT

Not Applicable.

BACKGROUND

1. Field

The present disclosure pertains to a vertical top-fed grain mill (degermer). More particularly, the present disclosure relates to a grain milling machine which causes intermittent compression of grains while reducing potential overmilling.

2. Description of the Related Art

Milling machines are well known wherein grains, such as corn kernels, are debranned and the germ freed or exposed by application of impact force. Grains are supplied from a feeding inlet to a milling chamber having a milling roll, which serves as an impeller and which typically has an abrasive surface. The grains are then circulated by the milling roll, induced to move due to contact with the milling roll's abrasive surface, and are milled until exiting. The milling roll may include one or more agitating projections or stirring bars mounted on the milling roll within the milling chamber and/or may be elliptical to circulate the grains within the mill. During circulation, the grains rub one another, causing the bran layer to separate from the endosperm and germ. If the distance between the exterior of the milling roll and the milling chamber varies, such as by use of an elliptical milling roll or by use of a polygonal screen defining the exterior of the milling chamber, the grains within the milling chamber are additionally intermittently compressed, increasing the friction between the grains and increasing the internal stresses within the grains, thereby speeding bran removal and grain fracturing, respectively. Typically, a screen defines the extent of the milling chamber. The screen includes perforations to permit grain fragments, generally referred to as brokens, which may be germ, endosperm, bran or a combination thereof, of less than a maximum size, to exit the milling chamber. The force applied to the grains and the associated speed of processing may also be affected by selection of the size, density and direction of the perforations. Additionally, breaks or breaker bars may be installed about the screen that produce further localized areas of compression, which result in further fracturing of the kernels, or propagation of existing fractures within the kernels. Sufficient milling for exposing germ or for reduction of the grain broken size may be controlled by requiring a minimum force be applied to a discharge gate by or through the adjacent grains. Removal of sufficiently milled kernel brokens prior to reaching the top of the milling chamber may be permitted by sufficiently sized perforations in the screen. Those brokens passing through the screen are known as throughs. The grains and brokens passing through the mill to the output are known as overtails.

Various milling systems are known in the art for milling of grains. Some mills are horizontally aligned, wherein grains are input at one end of a horizontal-oriented mill, travel horizontally during milling and then exit. The Beall-type degermer is one such well-known horizontally-oriented mill. In a Beall-type degermer, corn is fed into and through the annulus at one end and between a rotating, conical rotor and a stationary concentric screen made of perforated metal. Both rotor and screen are textured with large nodes, which impede motion of the kernels as they are impelled by the rotor.

Other mills are vertically-aligned, wherein grains are input at the top or the bottom of a vertically-oriented mill, travel downward or upward, respectively, during milling and then exit One such machine is the Satake Maize Degermer VBF. During rotation of the milling rotor in a vertical degermer, the corn is circulated horizontally by the milling rotor and is retained by the surrounding screen while moving in the vertical plan.

In both type of mills, as bran layers may remain with the pieces of endosperm after processing, further refinement may be necessary to reduce the fiber content of the endosperm product.

Problematically, grains that are sufficiently fractured early in the milling process continue to be milled with insufficiently fractured grains, often resulting in excessive milling and thereby degradation of products. It is generally desirable to minimize the production of fine particles, known as "fines" as these fines are difficult to separate in order to recover as a marketable product. One resolution has been the positioning of breaker bars at the section of the screen adjacent the discharge to accelerate fracturing of the kernels immediately prior to discharge. The breaker bars may substantially affect the output and milling time, as well as the power applied by the milling roll to the grains.

In horizontal mills and vertical bottom-fed mills, a substantial amount of energy is required for milling, which includes the energy needed to introduce grains to the machine and to drive already-present grains toward discharge. Vertical top-fed mills may avoid this issue by introducing grains at the top, but must then address the problem of increased milling resulting from the weight of the newly introduced grains atop those grains already being processed in connection with the abrasive roll.

Frequent screen replacement is typical in these mills, particularly as the screen surrounding the milling chamber wears, and often wears unevenly, particularly adjacent the point of introduction of the grains. The constant abrasion of the grains wears the periphery of the perforations of the screen. Such wear requires frequent screen replacement even though the remaining portions of the screen remain usable.

Thus, there is a need in the art for vertical grain mill which sufficiently mills grain at high rates of processing while addressing shortcomings of the prior art.

SUMMARY

The present disclosure therefore meets the above needs and overcomes one or more deficiencies in the prior art by providing a vertical grain mill which sufficiently mills grain at high rates of processing while addressing shortcomings of the prior art. In a first embodiment, the top-fed vertical grain mill includes a main shaft, a roll assembly, a bran removal cylinder, a resistor bar, a grain inlet and an overtails outlet. The main shaft is vertical, rotatable and has an upper portion. The roll assembly includes a plurality of rolls concentrically, removably affixed to the upper portion of the main shaft. Each of the rolls has a smooth, metal vertical outer periphery, a horizontal round cylindrical body of common diameter, a top surface and a bottom surface. On the outer periphery of each roll is a vertically-aligned stirring bar. The bran removal cylinder is vertically aligned and concentrically positioned distant the outer periphery of the plurality of rolls and has a plurality of perforations therethrough below the bottom surface of the top-most of the plurality of rolls. The resistor bar is substantially vertical and positioned on an interior of the bran removal cylinder. The grain inlet, above the roll assembly, permits the provision of grain to the milling chamber between the roll assembly and the bran removal cylinder. The overtails outlet, below the roll assembly, permits the provision of overtails from the milling chamber.

In a second embodiment, the top-fed vertical grain mill includes a main shaft, a roll assembly, a bran removal cylinder, a resistor bar, an grain inlet and an overtails outlet. The main shaft is vertical, rotatable and has an upper portion. The roll assembly is removably concentrically affixed to the upper portion of the main shaft and includes a plurality of metal rolls removably concentrically affixed to the upper portion of the main shaft. Each of the plurality of rolls having a smooth, metal vertical outer periphery, a horizontal round cylindrical body of common diameter, a top surface and a bottom surface. On the outer periphery of each of the plurality of metal rolls, a vertically-aligned stirring bar is provided. The bran removal cylinder, which is internally round and vertical concentrically positioned distant the roll assembly, has a plurality of perforations therethrough. The resistor bar is substantially vertical and positioned on an interior of the bran removal cylinder. The grain inlet, above the roll assembly, permits the provision of grain to the milling chamber between the roll assembly and the bran removal cylinder. The overtails outlet, below the roll assembly, permits the provision of overtails from the milling chamber.

The present disclosure provides a mill which provides for efficient removal of bran from a grain, such as corn, while simultaneously breaking the endosperm into fractions, also know as grits, maximizing "large grit" while minimizing "small grit." The present disclosure further provides a mill which aids in separation of germ from endosperm fractions so as to minimize fat or oil contamination of the grits.

Additional aspects, advantages, and embodiments of the disclosure will become apparent to those skilled in the art from the following description of the various embodiments and related drawings.

BRIEF DESCRIPTION OF THE DRAWINGS

So that the manner in which the described features, advantages, and objects of the disclosure, as well as others which will become apparent are attained and can be understood in detail; more particular description of the disclosure briefly summarized above may be had by referring to the embodiments thereof that are illustrated in the drawings, which drawings form a part of this specification. It is to be noted, however, that the appended drawings illustrate only typical preferred embodiments of the disclosure and are therefore not to be considered limiting of its scope as the disclosure may admit to other equally effective embodiments.

In the drawings.

DESCRIPTION

Figure 1:
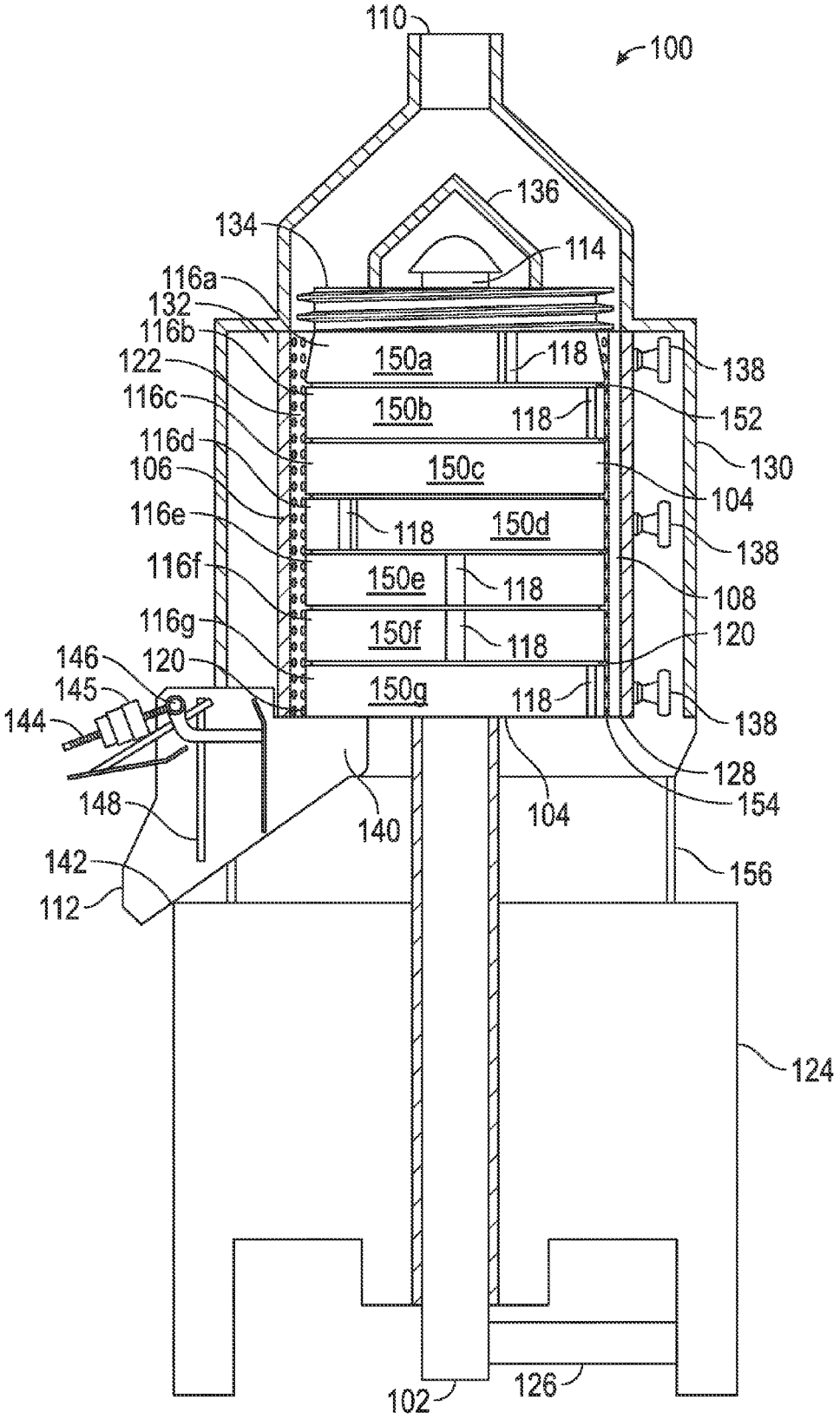
FIG. 1 is an illustration of one embodiment of the present disclosure along its center illustrating the various components.
Figure 2:
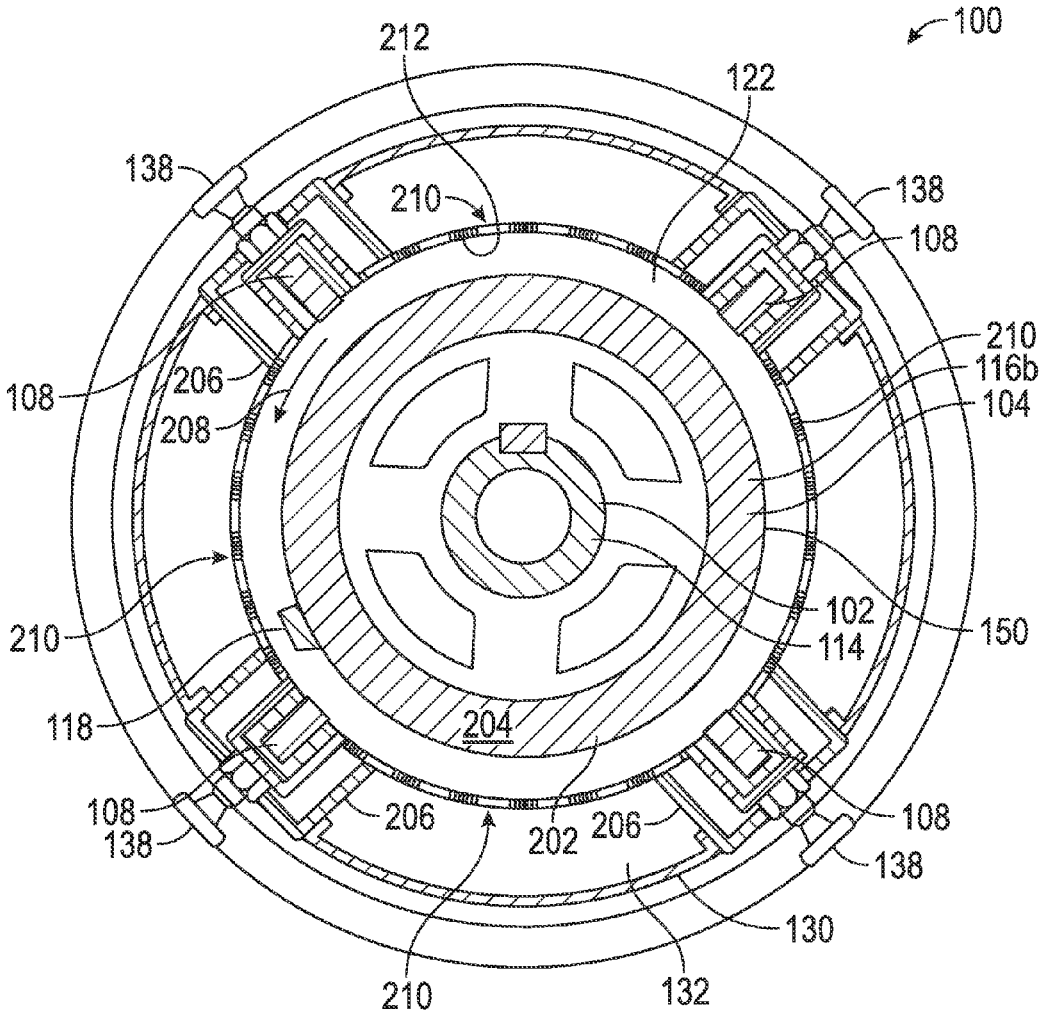
FIG. 2 is an illustration of the embodiment of FIG. 1 taken along plane A-A.
Figure 5:
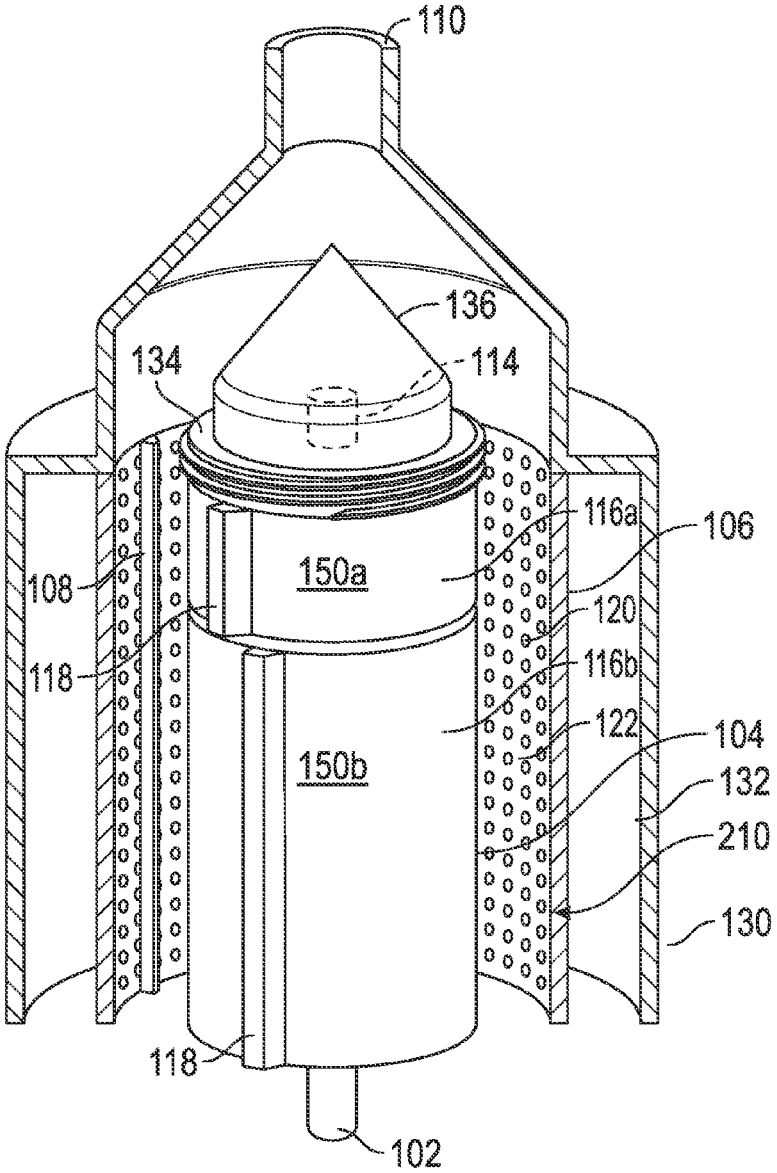
FIG. 5 is an illustration of an exploded view of various components of the present disclosure for a second embodiment of the disclosure.

Referring to FIG. 1, the top-fed vertical grain mill 100 according to the present disclosure is illustrated. The top-fed vertical grain mill 100 includes a main shaft 102, a roll assembly 104, a bran removal cylinder 106, a resistor bar 108, a grain inlet 110 and an overtails outlet 112. The main shaft 102 is vertical, rotatable and has an upper portion 114. The roll assembly 104 includes a plurality of rolls 116*a*-116*g* concentrically, removably affixed to the upper portion 114 of the main shaft 102. Referring to FIGS. 1, 2, and 5, each of the rolls 116*a*-116*g* has a smooth, metal substantially-vertical outer periphery 150*a*-150*g*, a horizontal round cylindrical body 202 of common maximum diameter, a top surface 204 and a bottom surface 152. On the outer periphery 150 of each roll 116 is a vertically-aligned stirring bar 118. The bran removal cylinder 106 is vertically aligned and concentrically positioned distant the outer periphery 150*a*-150*g* of the plurality of rolls 116*a*-166*g* and has a plurality of perforations 120 therethrough, in one embodiment limited to a position below the bottom surface 152 of the top-most of the plurality of rolls 116*a* and the bottom 154 of the bran removal cylinder 106. The resistor bar 108 is substantially vertical and positioned on an interior of the bran removal cylinder 106. The grain inlet 110, above the roll assembly 104, permits the provision of grain to the milling chamber 122 between the roll assembly 104 and the bran removal cylinder 106. The overtails outlet 112, below the roll assembly 104, permits the provision of overtails from the milling chamber 122.

Referring to FIG. 1, the top-fed vertical grain mill 100 may also include a frame 124, wherein the main shaft 102, and therefore also the roll assembly 104, is supported. A motor 126 may be affixed to the frame 124 and coupled to the main shaft 102 to cause rotation of the main shaft 102, and therefore of the roll assembly 104, during operation of the top-fed vertical grain mill 100. The frame 124 may include a horizontal surface 128 below the roll assembly 104 to define the bottom of the milling chamber 122. The overtails outlet 112, positioned below the horizontal surface 128, may be affixed to the frame 124, which may include an orifice through the horizontal surface 128 of the frame 124 for communication between the milling chamber 122 and the overtails outlet 112. Referring to FIG. 2, the bran removal cylinder 106 may be attached to the frame 124 by attachment to pillars 206 of the frame 124. Referring to FIGS. 1 and 2, an outer wall 130 may be attached to the frame 124 and may be placed external to the bran removal cylinder 106, defining an annular bran removing chamber 132. This annual bran removing chamber 132 may communicate with a throughs outlet 156 for removal of the throughs from the top-fed vertical grain mill 100. Referring again to FIG. 1, the grain inlet 110 is connected to the frame 124 and provides the inlet for gravity-supplied grain to enter the top-fed vertical grain mill 100. The frame 124 may also support a guide body 136. When falling grain enters the top-fed vertical grain mill 100 through the grain inlet 110, it first contacts the guide body 136, then is guided to a spiral rotor, or conveyor, 134 mounted to the main shaft 102. The spiral rotor 134 then provides grain from the grain inlet 110 to the milling chamber 122 so as to be generally equivalently dispersed in the milling chamber 122.

Referring to FIGS. 1 and 2, each roll 116 of the roll assembly 104 provides a smooth, metal substantially-vertical outer periphery 150*a*-150*g* rather than an abrasive surface, such as an emery stone typically used as an abrasive grinding stone. While some surface imperfections of the outer periphery 150*a*-150*g* may result in some friction between the grains and the roll 116*a*-116*g*, the coefficient of friction is negligible and therefore does not provide sufficient friction to aggressively wear the bran from the exterior of the grain. Any change in the application of force applied to the grains by the roll 116*a*-116*g* itself is further reduced by using rolls 116*a*-116*g* which are round, rather than elliptical. Each of these rolls 116*a*-116*g* is then attached to the main shaft 102, and each 116*a*-116*g* may be separated from an adjacent vertically-adjacent roll 116*a*-116*g* by a spacer inserted between the rolls 116*a*-116*g* or by a gapping system intended to provide positive airflow such as from main shaft 102, if a hollow main shaft is used, to the milling chamber 122. Once each roll 116*a*-116*g* is affixed to the main shaft 102, an integral unit—the roll assembly 104—is formed. The outer periphery 150*a*-150*g* of the rolls 116*a*-116*g* in the roll assembly 104 defines the inner diameter of the milling chamber 122. As can be appreciated, in the roll assembly 104, the topmost roll 116*a* might not have an outer periphery 150*a* which is entirely vertical, but rather may have an outer periphery 150*a* which is only substantially vertical, such that the top surface of the topmost roll 116*a* may be smaller in diameter than the bottom surface 152 of the topmost roll 116*a*, producing a canted periphery 150*a* which aids in the downward flow of the grains introduced to the top-fed vertical grain mill 100. Preferably, the outer periphery 150*a*-150*g* of each of the rolls 116*a*-116*g* is formed of steel, which is sufficiently smooth as to prevent undesirably grain rubbing and which is sufficiently durable to resist the wearing forces from the grain passing through the top-fed vertical grain mill 100.

Figure 3:
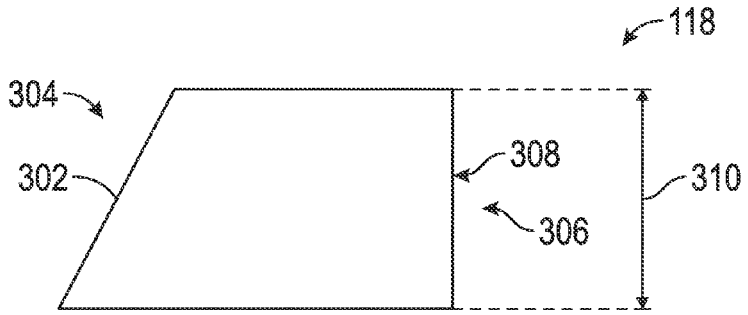
FIG. 3 is an illustration of a side view of an embodiment of a stirring bar of the present disclosure.

At least one vertically-aligned stirring bar 118 is affixed, such as by one or more bolts, or other fastening systems, to each roll 116*a*-116*g* of the roll assembly 104 on its outer periphery 150*a*-150*g*, preferably having a height equal to that of the roll 116*a*-116*g* such that the stirring bar 118 extends from the top surface 204 to the bottom surface of the roll assembly 104. More than one stirring bar 118 may be utilized, provided sufficient spacing about the periphery of the roll 116*a*-116*g* is provided so that grains may be contacted by and impelled by the stirring bar 118. The thickness of the stirring bar 118 is selected to ensure the quantity, size, and type of grain in the mill, such as corn, barley, or wheat, is induced to move about the milling chamber 122 during operation. Barley, for example, provides a grain notably smaller than corn, and therefore would require a milling chamber 122 and stirring bar 118 sized differently than a milling chamber 122 and stirring bar 118 for use in connection with corn. The various rolls 116*a*-116*g* preferably, but not necessarily, are positioned on the main shaft 102 so that the associated stirring bars 118 are not aligned vertically. Each stirring bar 118 is made of a durable material, such as steel, sufficient to endure the force of the grains on its surface during rotation. Each stirring bar 118 provides a profile extending sufficiently from the outer periphery 150*a*-150*g* of each roll 116*a*-116*g* to induce movement of the grains adjacent the roll 116*a*-116*g*. Referring to FIGS. 2 and 3, this profile may be a trapezoidal prism. Alternatively, the profile of the stirring bar 118 may be another shape sufficient to induce movement, such as half an elliptical cylinder—which may be used to avoid the generation of an edge which may cause localized stresses in the grains from the stirring bar 118. The stirring bar 118 has a height substantially equal to the height of the roll 116. Referring to FIGS. 2 and 3, each stirring bar 118 may be mounted on a roll 116*a*-116*g* such that its vertically extending chamfer 302 is found on the forward side 304 in the rotational direction 208 of the roll assembly 104 and that its vertically extending edge portion (rising portion) 306 is found on the rear side 308. By mounting stirring bar 118 such that the chamfer 302 is on the forward side 304 in the rotational direction 208 of the roll assembly 104, a comparatively gentle stirring action is obtainable.

The bran removal cylinder 106, which defines the outer boundary of the milling chamber 122, is internally-round, vertical cylinder concentrically positioned distant the outer periphery 150*a*-150*g* of each of the plurality of rolls 116*a*-116*g*. The bran removal cylinder 106 may be formed of two or more segments 210 which may be joined together to provide the uprightly-formed round cylinder 106, and is formed of a durable material, such as steel, sufficient to endure the force of the grains on its surface 212 during rotation.

Figure 4:
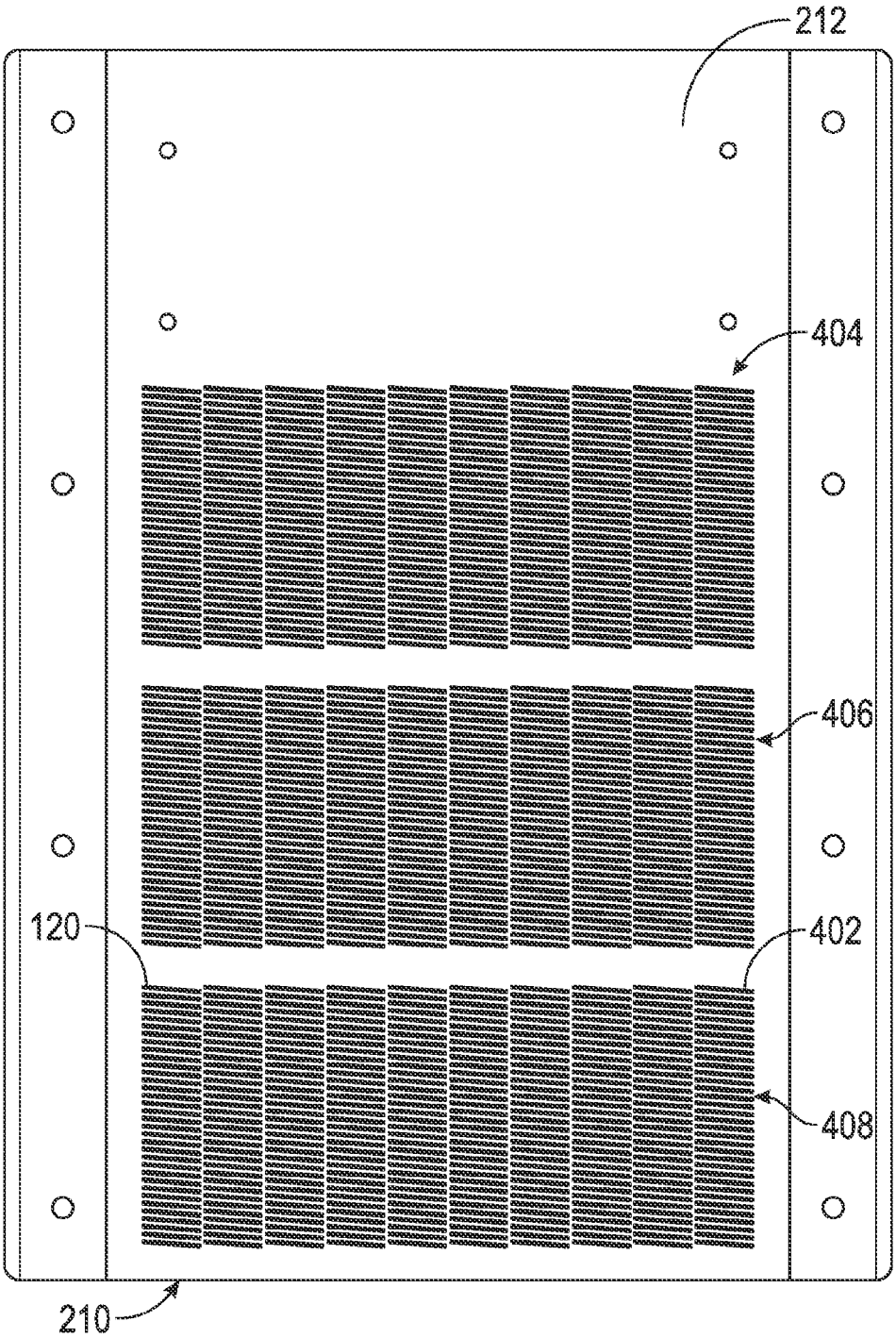
FIG. 4 is an illustration of a screen segment of the bran removal cylinder of the present disclosure.

The bran removal cylinder 106 has a plurality of perforations 120 therethrough. In the first embodiment, these perforations 120 may be limited to the area below the bottom surface 152 of a top-most roll 116*a* of the plurality of rolls 116*a*-116*g*. The size, alignment, direction, and shape of the perforations 120 may be selected depending on a number of factors, including grain type, water content, desired bran size, and rate of milling. Perforations 120 may be round or elliptical and, in the case of elliptical perforations may be angled relative to the screen surface 212. Thus, the bran removal cylinder 106 has a porous wall portion and is uprightly formed. Perforations 120 therefore are laterally present about the entire inner circumference of the bran removal cylinder 106. As depicted in FIG. 4, in connection with a four piece bran removal cylinder 106, such as depicted in FIG. 2, the perforations 120 may be slotted perforations 402, essentially elliptical in shape and angled upwards from the horizontal plan when viewed from direction of rotation 208. Other sizes (width, height, orientation, and shape) and arrangements of perforations 120 may be used, subject to the restriction that none are operable above the bottom surface 152 of the top roll 116*a* of the plurality of rolls 116*a*-116*g*. Where slotted perforations 402 are used, each may be 25 millimeters in length with a 0.9 millimeter height, on 3.5 millimeter centers, at an angle of not more than 7.5 degrees and not less than 2.7 degrees, and preferably about 4.6 degrees. These perforations 402 may be grouped to address the second and third rolls 116*b*, 116*c* in a first perforation group 404, to address the fourth and fifth rolls 116*d*, 116*e* in a second perforation group 406, and the sixth and seventh rolls 116*f*, 116*g* in a third perforation group 408, if seven rolls are used. As depicted in FIGS. 1 and 4, in one embodiment, the perforations 120 are not found above the bottom surface 152 of the top roll 116*a* of the plurality of rolls 116*a*-116*g* should the milling obtained by a top-fed vertical grain mill 100 using a smooth roll with a stirring bar 118, a round screen 106, and a resistor bar 118 cause the bran removal cylinder 106 to wear out rapidly at the portion adjacent the top roll 116*a*. Alternatively, the perforations 120, 402 may be found throughout the bran removal cylinder 106, including above the bottom surface 152 of the top roll 116*a* of the plurality of rolls 116*a*-116*g*

Figure 8:
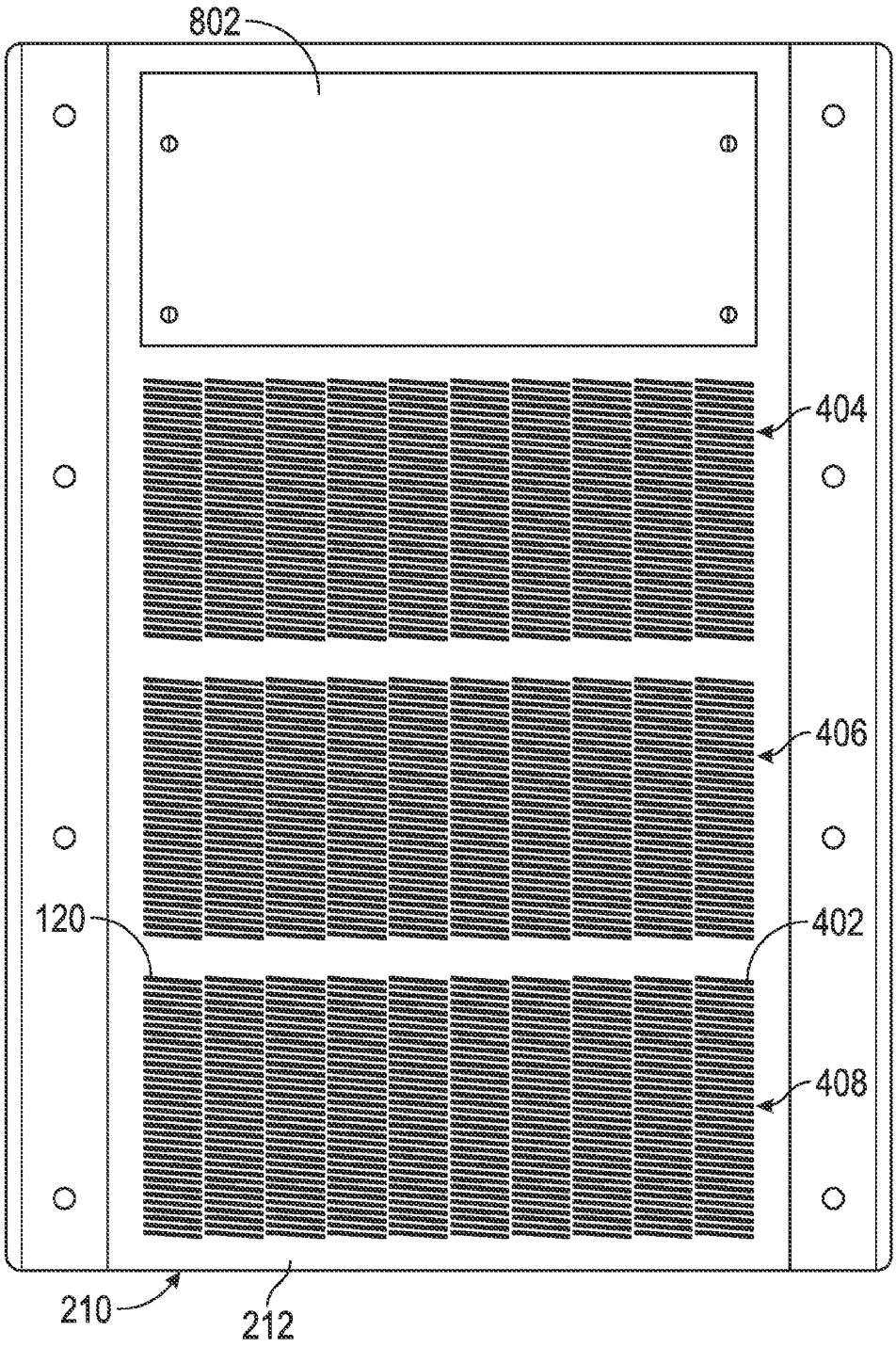
FIG. 8 is an illustration of a screen segment of the bran removal cylinder with a wear plate.

Additionally, referring to FIG. 8, a wear plate 802 may be affixed to the bran removal cylinder 106 in the area opposite the first roll 116*a* when the bran removal cylinder 106 is installed. The wear plate 802 is provided without any perforations and is sized to fit to and within the bran removal cylinder 106 without interfering with operation of the top-fed vertical grain mill 100, particularly with regard to the stirring bar 118 associated with the first roll 116*a* and the resistor bar 108. Thus, an internally-round, vertical wear plate 802 is affixed internally to the internally-round, vertical bran removal cylinder 106 above the bottom surface 152 of the top-most of the plurality of rolls 116*a*. The internally-round, vertical bran removal cylinder 106 may therefore include the limitation of the perforations 120 being only below the bottom surface 152 of a top-most 150*a* of the plurality of metal rolls 150*a*-150*g* or may include perforations 120 above the bottom surface 152 of a top-most 150*a* of the plurality of metal rolls 150*a*-150*g* which are then masked from contact with product by the wear plate 802.

Figure 6:
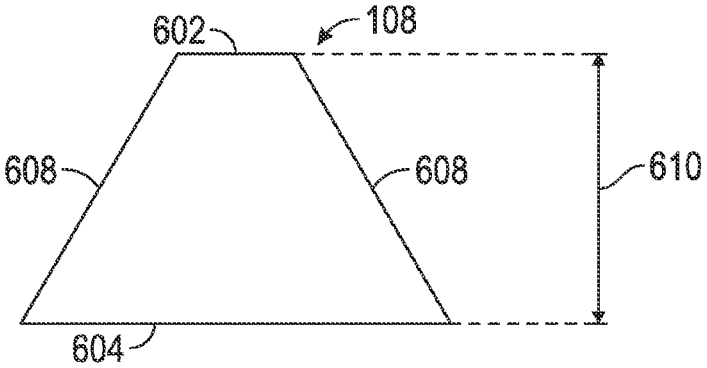
FIG. 6 is an illustration of a side view of an embodiment of resistor bar of the present disclosure.

At least one substantially vertical resistor bar 108 is positioned on the interior of the bran removal cylinder 106, preferably spanning the entire height of the bran removal cylinder 106. The resistor bar 108 may be affixed to a portion of the frame 124 surrounding the bran removal cylinder 106, as illustrated in FIG. 1, or directly to the bran removal cylinder 106, as illustrated in FIG. 5. Each resistor bar 108 may be inserted or extracted using a plurality of knob bolts 138. Each resistor bar 108 is made of a durable material, such as steel, sufficient to endure the force of the grains on its surface during contact. Each resistor bar 108 provides a profile extending sufficiently from the screen surface 212 of the bran removal cylinder 106 to retard movement of the grains adjacent the bran removal cylinder 106 in the milling chamber 122. This may be accomplished by a rectangular profile, such as illustrated in FIG. 2, or a trapezoidal prism profile which may include a parallel top 602 and bottom 604 and chamfers front 606 and rear 608 of equal cant, such as depicted in FIG. 6, or another shape sufficient to retard movement, such as half an elliptical cylinder. The sum of the height 310 of a stirring bar 118 and the height 610 of a resistor bar 108 is greater than the distance between the outer periphery 150*a*-150*g* of the plurality of rolls 116*a*-116*g* and screen surface 212 of the bran removal cylinder 106, so that a stirring bar 118 may rotate past a resistor bar 108 without interference other than that caused the intermediate grains.

The overtails outlet 112 is disposed at the lower end of the milling chamber 122 so as to discharge the grain milled by the top-fed vertical grain mill 100. The overtails outlet 112 includes a discharge port 140 that is formed by opening a part of the bran removal cylinder 106, an outlet opening 142 that is connected to the discharge port 140, a weight lever 144 that is fixed to a shaft 146 transversely suspended on the outlet opening 142, a resisting plate 148 that is pivoted to one end of the weight lever 144 and faces the discharge port 140 so as to block it, and a weight 145 that is movably attached to the other end of the weight lever 144.

In operation, the motor 126 causes the main shaft 102 to rotate, during which grain, particularly corn, is introduced to the top-fed vertical grain mill 100 via the grain inlet 110. Various systems are known in the art for distribution of downwardly falling grain from a source to the milling chamber 122. In one embodiment, prior to introduction to the top-fed vertical grain mill 100, the grain may be stored any various systems known in the art, including a raw material tank, which may be associated with a valve to control flow of grain into the top-fed vertical grain mill 100. The downwardly flowing grain introduced to top-fed vertical grain mill 100 is somewhat equally dispersed circumferentially by the guide body 136, which provides a cone for distribution of grain, and which them conveys the grain to the spiral rotor 134. The grain is then introduced to the milling chamber 122 by the spiral rotor 134.

The grain enters the milling chamber 122, which may including impinging on the outer periphery 150*a* of the first roll 116*a* plurality of rolls 116. Grain then at least partially fills the milling chamber 122, potentially until the entire milling chamber 122 is full and grain is standing in the grain inlet 110. It is therefore desirable to provide a canted outer periphery 150*a* of the first roll 116*a* of the plurality of rolls 116*a*-116*g* to aid in efficient introduction of grain to the milling chamber 122 and to avoid undesirable overwear of the portion of the bran removal cylinder 116 adjacent thereto. During this filling and afterward during operation, the rolls 116*a*-116*g* are being rotated due to their connection to the main shaft 102. Due to the rotation of the rolls 116 in the roll assembly 104, the stirring bars 118 are rotating about the main shaft 102 in the milling chamber 122, impelling grains circumferentially about the roll assembly 104.

Because the bran removal cylinder 116 is round, rather than a polygonal screen, the bran removal cylinder causes no localized areas of varying stress and force within the grains. Polygonal screens, because of the varying distance between the screen and roll assembly, generate areas of low force and inter-grain friction—at the point of greatest distance between the screen and roll assembly, and areas of high force and inter-grain friction—at the point of least distance between the screen and roll assembly. Instead, because the distance between the bran removal cylinder 106, and particularly the bran removal chamber outer wall 132, is constant, the width of the milling chamber 122 is constant, with the exception of localized areas about the resistor bars 108 and the stirring bars 118, the force applied among the grains, which initially will cause inter-grain friction and separation of bran by rubbing and then will cause propagation of fractures through the remaining germ/endosperm/bran of the grains, has a substantially smaller variance. The smooth, durable outer periphery 150*a*-150*g* of each of the plurality of rolls 116*a*-116*g* reduces the rotational force and rubbing introduced by the rolls 116*a*-116*g* to a negligible value.

As the rolls 116*a*-116*g* are being rotated and the stirring bars 118 impel grains circumferentially about the roll assembly 104 within the milling chamber 122, the movement of the grains, broken grains and debranned grains, is retarded by the resistor bar 108, which increases the inter-grain force and provides a localized area of higher force and stress in the milling chamber 122 which increases the separation of bran by rubbing and the propagation of fractures through the remaining germ/endosperm/bran of the grains, i.e., grain milling.

Coupled with the lack of rubbing from the smooth rolls 116, the increases in inter-grain rubbing from the stirring bars 118 and the resistor bar 108, the construction of the perforations 120 in the bran removal cylinder 106 increases the rate of milling while avoiding overmilling. The perforations 120 permit the throughs, including bran and any overmilled "fines", to exit the milling chamber 122, while retaining the remaining grain components. Additionally, the perforations 120 in the bran removal cylinder 106 present surfaces which cause impact forces to be applied to passing grains, causing those grains to fracture into desirable components.

The milled grain components not exiting the milling chamber 122 but rather exiting via the overtails outlet 112 are, as a result of a top-fed mill with beneficially sufficiently milled without issues of overmilling or undermilling.

Figure 7:
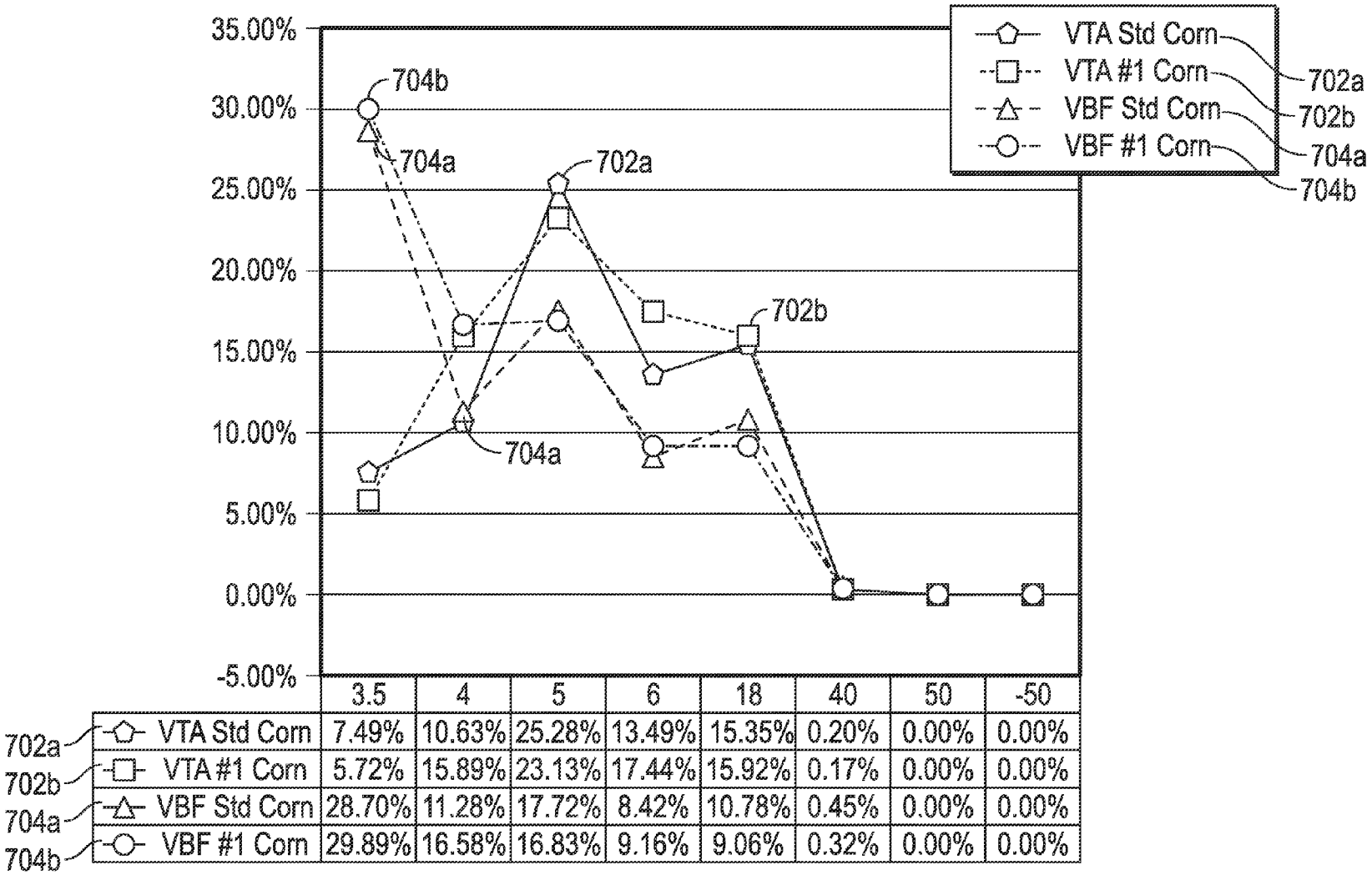
FIG. 7 is an illustration of an actual test result comparing the output of an embodiment of a disclosure to an existing bottom-fed mill for two types of corn.

Beneficially, the combination of the smooth roll 116*a*-116*g* with a stirring bar 118, a round screen 106 where the perforations are limited to the area below the bottom surface 152 of a top-most roll 116*a* of the plurality of rolls 116*a*-116*g*, and a resistor bar 118 result in a more desirable output. The output of the top-fed vertical grain mill 100 for two corn types 702*a*, 704*a*, is better in size and distribution for mesh sizes than the output from a conventional mill for the same corn two types 702*b*, 704*b* as illustrated in FIG. 7.

Thus, the top-fed vertical grain mill 100 provides for efficient removal of bran from a grain, such as corn, while simultaneously breaking the endosperm into fractions, also known as grits, maximizing "large grit" while minimizing "small grit." The top-fed vertical grain mill 100 aids in separation of germ from endosperm fractions so as to minimize fat or oil contamination of the grits. Referring to FIG. 7, the top-fed vertical grain mill 100 provides a desirable granulation distribution of corn grits. The top-fed vertical grain mill 100 produces higher percentages of larger grit (+4 Mesh, +5 Mesh, +6 Mesh) while simultaneously reducing the percentage of large unbroken kernels (grains) (+3.5 Mesh). This improved distribution impacts the requirements for further processing or recycling of the +3.5 Mesh Fraction, particularly the need for additionally machine content, horsepower and the like.

The terms and expressions which have been employed in the foregoing specification are used therein as terms of description and not of limitation, and there is no intention, in the use of such terms and expressions, of excluding equivalents of the features shown and described or portions thereof. It will be evident to those skilled in the art that various modifications and changes can be made thereto without departing from the broader spirit or scope of the disclosure. Accordingly, the specification is to be regarded in an illustrative rather than a restrictive sense. It is therefore, contemplated that various alternative embodiments and modifications may be made to the disclosed embodiments without departing from the spirit and scope of the disclosure defined by the appended claims and equivalents thereof.

I claim:

1. A top-fed vertical grain mill, comprising:

a vertical, rotatable main shaft having an upper portion;

a roll assembly, the roll assembly having a plurality of rolls removably concentrically affixed to the upper portion of the main shaft, each of the plurality of rolls having a smooth, metal substantially vertical outer periphery, a horizontal round cylindrical body of common diameter, a top surface and a bottom surface, a vertically-aligned stirring bar provided on the outer periphery of each of the plurality of rolls;

an internally-round, vertical bran removal cylinder concentrically positioned distant the outer periphery of each of the plurality of rolls, the bran removal cylinder having a plurality of perforations therethrough below the bottom surface of a top-most of the plurality of rolls;

a resistor bar, the resistor bar substantially vertical and positioned on an interior of the bran removal cylinder;

a grain inlet to a milling chamber between the roll assembly and the bran removal cylinder, the grain inlet above the roll assembly; and a overtails outlet from the milling chamber, the overtails outlet below the roll assembly.

2. The mill of claim 1, wherein the smooth, metal vertical outer periphery of each of the plurality of rolls is formed of steel.

3. The mill of claim 2, wherein the stirring bar includes a chamfer formed on a forward side with respect to a direction of travel of the plurality of rolls.

4. The mill of claim 3, wherein each of the plurality of perforations is one of round in shape and slotted in shape.

5. The mill of claim 4, wherein each of the plurality of perforations is about 25 millimeters in length, about 0.9 millimeter height, on 3.5 millimeter centers, and at an angle of not more than 7.5 degrees and not less than 2.7 degrees.

6. The mill of claim 5, further comprising an internally-round, vertical wear plate affixed internally to the internally-round, vertical bran removal cylinder corresponding to the area above the bottom surface of a top-most of the plurality of rolls.

7. The mill of claim 1, further comprising an internally-round, vertical wear plate affixed internally to the internally-round, vertical bran removal cylinder corresponding to the area above the bottom surface of a top-most of the plurality of rolls.

8. The mill of claim 7, wherein said internally-round vertical wear plate is without perforations therethrough.

9. A top-fed vertical grain mill, comprising:

a vertical, rotatable main shaft having an upper portion;

a roll assembly removably concentrically affixed to the upper portion of the main shaft, the roll assembly having a plurality of metal rolls, each of the plurality of rolls having a smooth, metal substantially-vertical outer periphery, a horizontal round cylindrical body of common diameter, a top surface and a bottom surface, a vertically-aligned stirring bar provided on the outer periphery of each of the plurality of metal rolls;

an internally-round, vertical bran removal cylinder concentrically positioned distant the roll assembly, the bran removal cylinder having a plurality of perforations therethrough;

a resistor bar, the resistor bar substantially vertical and positioned on an interior of the bran removal cylinder;

a grain inlet to a milling chamber between the roll assembly and the bran removal cylinder, the grain inlet above the roll assembly; and a overtails outlet from the milling chamber, the overtails outlet below the roll assembly.

10. The mill of claim 9, wherein none of the plurality of perforations are positioned above the bottom surface of a top-most of the plurality of metal rolls.

11. The mill of claim 9, wherein the smooth, metal vertical outer periphery of each of the plurality of rolls is formed of steel.

12. The mill of claim 11, wherein the stirring bar includes a chamfer formed on a forward side with respect to a direction of travel of the plurality of rolls.

13. The mill of claim 12, wherein each of the plurality of perforations is one of round in shape and slotted in shape.

14. The mill of claim 13, wherein each of the plurality of perforations is about 25 millimeters in length, about 0.9 millimeter height, on 3.5 millimeter centers, and at an angle of not more than 7.5 degrees and not less than 2.7 degrees.

15. The mill of claim 14, further comprising an internally-round, vertical wear plate affixed internally to the internally-round, vertical bran removal cylinder corresponding to the area above the bottom surface of a top-most of the plurality of rolls.

16. The mill of claim 11, further comprising an internally-round, vertical wear plate affixed internally to the internally-round, vertical bran removal cylinder corresponding to the area above the bottom surface of a top-most of the plurality of rolls.

17. The mill of claim 16, wherein said internally-round vertical wear plate is without perforations therethrough.

18. The mill of claim 17, wherein said perforations through said bran removal cylinder are positioned below the bottom surface of a top-most of the plurality of rolls.

* * * * *